United States Patent [19]

Weirich et al.

[11] Patent Number: 4,737,052

[45] Date of Patent: Apr. 12, 1988

[54] DISTRIBUTOR

[75] Inventors: Walter Weirich, Dortmund; Bernd Peters, Dülmen, both of Fed. Rep. of Germany

[73] Assignee: Gewerkschaft Eisenhutte Westfalia GmbH, Lunen, Fed. Rep. of Germany

[21] Appl. No.: 24,434

[22] Filed: Mar. 11, 1987

[30] Foreign Application Priority Data

Mar. 12, 1986 [DE] Fed. Rep. of Germany ..... 3608181

[51] Int. Cl.[4] ..... E21D 23/16

[52] U.S. Cl. ..... 405/302; 91/170 MP

[58] Field of Search ..... 405/291, 302; 91/170 MP, 508, 525, 530; 299/31, 33

[56] References Cited

U.S. PATENT DOCUMENTS

| | | | |
|---|---|---|---|
| 4,159,671 | 7/1979 | Allen | 405/302 X |
| 4,327,628 | 5/1982 | Weirich et al. | 405/302 X |
| 4,379,662 | 4/1983 | Block | 405/302 |

*Primary Examiner*—David H. Corbin

*Attorney, Agent, or Firm*—Sughrue, Mion, Zinn, Macpeak and Seas

[57] ABSTRACT

The invention relates to a distributor for controlling hydraulic distribution between hydraulic consumers of a mine roof support unit and hydraulic supply lines extending along a mine working. The distributor comprises a supply block provided with a plurality of pairs of main hose connections and a plurality of branch hose connections. The hose connections of each pair of main hose connections are connected by a respective main passage. Each branch hose connector is connected to a corresponding main passage by a respective branch passage. The supply block is provided with two sets of shut-off valves, the shut-off valves of one valve set being arranged in the main passages, and the shut-off valves of the other valve set being arranged in the branch passages. The hose connections of each pair of main hose connections are connected into a respective hydraulic supply line, and the branch hose connections are connected to the hydraulic consumers of the roof support unit.

13 Claims, 4 Drawing Sheets

DISTRIBUTOR

BACKGROUND TO THE INVENTION

This invention relates to a distributor for controlling hydraulic distribution between hydraulic consumers of a mine roof support unit and hydraulic lines extending along a mine working.

In a hydraulic longwall support assembly, the hydraulic supply lines, that is to say the hydraulic pressure and return lines for the hydraulic rams of the support units making up the assembly, a pressure water line for dust suppression spray nozzles carried by the units, and a hydraulic return line are laid longitudinally throughout the longwall working. The roof support units, which are positioned side-by-side along the working, are each connected to the supply lines by branch lines. The supply lines and/or the branch lines are provided with shut-off valves so that the supply lines can be isolated from the hydraulic consumers of the roof support units, for example in the execution of installation, repair or maintenance tasks.

The object of the invention is to provide a distributor which enables all the hydraulic consumers of a roof support unit to be connected to the various supply lines, which incorporates all the necessary shut-off valves into one compact unit, and which is usable as a standard fitting with hydraulic support units of different constructions.

SUMMARY OF THE INVENTION

The present invention provides a distributor for controlling hydraulic distribution between hydraulic consumers of a mine roof support unit and hydraulic lines extending along a mine working, the distributor comprising a supply block provided with a plurality of pairs of main hose connections and a plurality of branch hose connections, the hose connections of each pair of main hose connections being connected by a respective main passage formed within the supply block, and each branch hose connection being connected to a respective main passage by a respective branch passage, wherein at least one of the main passages houses a main shut-off valve, and at least one of the branch passages houses a branch shut-off valve.

In a preferred embodiment, the hose connections of a first pair of main hose connections are connected into a hydraulic high-pressure line, the hose connections of a second pair of main hose connections are connected into a hydraulic low-pressure line, the hose connections of a third pair of main hose connections are connected into a pressure water line, and the hose connections of a fourth pair of main hose connections are connected into a hydraulic return line, and the main passages connecting the first, second and third pair of main hose connections each houses a main shut-off valve, and the branch passages leading to said passages each houses a branch shut-off valve.

Thus, in accordance with the invention, all the hose connections which are connected into the supply lines, and all the branch hose connections leading to the hydraulic consumers, are assembled, together with their shut-off valves, in one compact supply block. Moreover, separate shut-off valves are provided for shutting-off the main passages, so that, according to need, either the hydraulic lines leading to the hydraulic consumers of the roof support unit and/or the hydraulic supply lines extending along the working can be shut off. The combination of all the above-mentioned components into the compact supply block leads to a simplification of the system, and thus also to an increase in working safety. It also results in a simplification of the installation work, and also to a reduction of constructional costs.

The fittings assembled in the supply block are expediently arranged spatially in relation to one another so as to result in a compact style of construction which is simple to manufacture and which is also user-compatible. In this respect, it is advantageous if the main hose connections are arranged on opposite side faces of the supply block, and the branch hose connections are situated on at least one other face of the supply block.

Preferably, each of the main shut-off valves has an actuating element, said actuating elements being positioned on a face of the supply block which is arranged at right-angles to said opposite side faces. Conveniently, each of the branch passages intersects the associated main passage at right-angles, and the branch hose connections are arranged on a face of the supply block which is arranged at right-angles to said side faces and opposite to that face on which the actuating elements of the main shut-off valves are positioned.

The supply block may be of generally L-shaped configuration when looking towards one of said side faces, the actuating elements of the main shut-off valves being arranged on the upper face of the supply block, and the branch hose connections being arranged on the underneath face of the supply block. Advantageously, each of the branch shut-off valves has an actuating element, at least some of the actuating elements of the branch shut-off valves being arranged on the L-shaped side faces of the supply block. A branch shut-off valve acuating element may be situated on a side face of the supply block that lies at right-angles to said side faces. Preferably, the supply block is generally T-shaped in cross-section with the main hose connections and the actuating elements of the main shut-off valves being arranged on the bar portion of the T-shaped section, and with the branch hose connections and the actuating elements of the branch shut-off valves being arranged on the upright of the T-shaped section.

Advantageously, the main passage connected into the return line is connected to two parallel branch passages, each of which leads to a branch hose connection. Preferably, a respective non-return valve is arranged in each of said parallel branch passages.

Each of the shut-off valves may have a valve closure member, and each passage accommodating a valve closure member may have detachably secured therein a respection connection socket, each connection socket serving to secure in position bearing and sealing rings associated with the respective valve closure member. Advantageously, the actuating elements of the main shut-off valves are actuating levers, each of which extends (when the associated valve is open) generally parallel to the direction of the associated main passage, and each of which extends (when the associated valve is closed) transversely to said direction. Preferably, the actuating elements of the branch shut-off valves are actuating levers, each of which extends (when the associated valve is open) generally parallel to the direction of the associated branch passage, and each of which extends (when the associated valve is closed) transversely to said direction.

BRIEF DESCRIPTION OF THE DRAWINGS

The invention will now be described in greater detail by way of example, with reference to the accompanying drawings, in which.

DESCRIPTION OF PREFERRED EMBODIMENT

Figure 1:
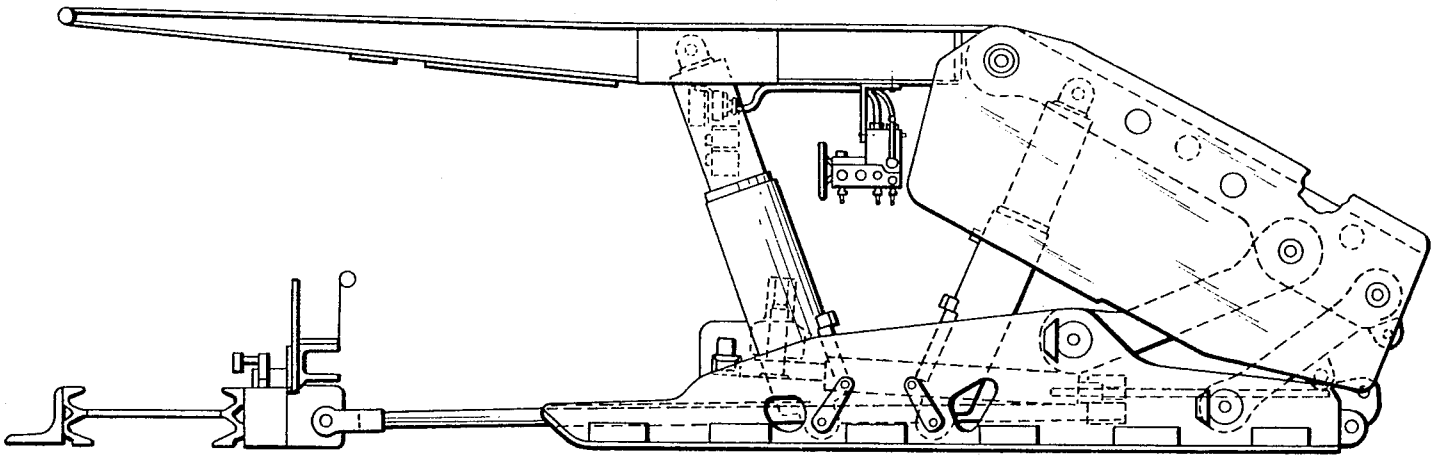
FIG. 1 is a side elevation of a mine roof support unit incorporating a distributor constructed in accordance with the invention.

Referring to the drawings, FIG. 1 shows a mine roof support unit provided with a distributor constructed in accordance with the invention. The roof support unit is positioned in a longwall working side-by-side with a plurality of similar roof support units, each of which is provided with a distributor constructed in accordance with the invention. Each distributor is used to connect the various hydraulic working units of the associated roof support unit to hydraulic supply lines which run the length of the working.

Each distributor consists of a compact supply block 1 which is formed with bores constituting conduit connections to the supply lines and the hydraulic working units, the bores also accommodating various valves. As shown in the side elevation of FIG. 3, the supply block 1 is generally L-shaped, while in the end view according to FIG. 4 it has a generally T-shaped outline, and in the plan view of FIG. 2 it has a generally rectangular outline. On each of its mutually-opposite faces 3 and 2, the supply block 1 has four laterally-spaced main hose connections 4 to 7 and 4' to 7' respectively, to which, on the inlet and outlet sides, the supply lines extending continuously along the longwall working are connected. The connections 4 to 7 on the side 3 and the connections 4' to 7' on the opposite side 2 of the supply block 1 lie opposite to one another, in pairs, and are connected within the supply block 1 in each case by a respective internal passage 8 (see FIG. 5). The connection pair 4,4' serves to connect the sections of a pressure water line (not shown) which extends along the longwall working and which supplies spray nozzles arranged on the associated roof support unit with pressurised water for dust suppression. The connection pair 5,5' serves to connect the sections of a longwall return line (not shown), the connection pair 6,6' serves to connect the sections of a longwall high-pressure line (not shown), and the connection pair 7,7' serves to connect the sections of a low-pressure line (not shown). The various hydraulic working units of the roof support units are charged with pressurised medium by way of the high-pressure line and the low-pressure line as is well known.

Branch passages 9 (see FIG. 5), each leading to a branch hose connection 4'', 5'', 6'', 7'', branch off at right-angles from the internal passages 8 connecting each of the above mentioned connection pairs. The branch hose connections 4'' to 7'' connect the various hydraulic working units of the associated roof support unit to the supply lines which extend continuously along the longwall working, the sections of which, as mentioned above, are connected to the main hose connections 4 to 7 and 4' to 7'. Accordingly, the pressure water connection takes place by way of the branch hose connection 4'', the return connection by way of the branch hose connection 5'', and the high-pressure and low-pressure connections to the associated roof support unit take place by way of the two branch hose connections 6'' and 7''. The branch connections 4'' to 7'' are situated on a face 10 of the supply block 1 which is at right-angles to the faces 2 and 3.

Figure 5:
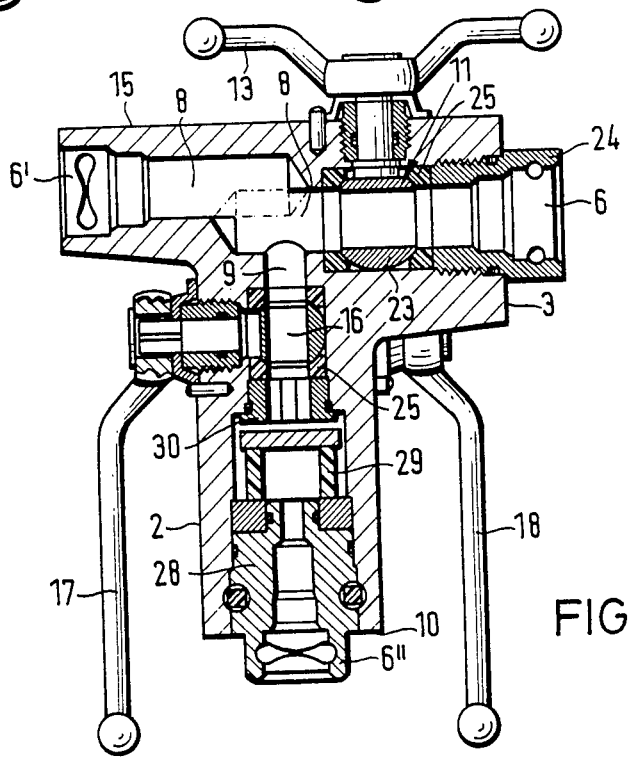
FIG. 5 is a cross-section taken on the line V—V of FIG. 3.

The supply block 1 also includes a set of main shut-off valves and a set of branch shut-off valves, which preferably all consist of ball valves. The main shut-off valves are arranged in the internal passages 8 which serve to transmit pressurised water, that is to say the passages between the main hose connections 4,4', 6,6' and 7,7'. FIG. 5 shows a single main shut-off valve 11, with which the internal passage 8 between the main hose connections 6,6' can be shut off at need. The shut-off valves 11 arranged in the internal passages 8 between the connection pairs 4,4' and 7,7' are formed in the same way. Actuating elements 12, 13 and 14 of the three main shut-off valves 11 lie on the same side 15 of the supply block 1, and each is constituted by a hand lever.

A respective branch shut-off valve 16 is arranged in each of the branch passages 9 conducting the pressure water, the high-pressure medium and the low-pressure medium. Each branch shut-off valve 16, which likewise consists of a ball valve, is used to close the associated passage 9 whenever necessary. The actuation of the branch shut-off valves 16 likewise takes place by means of hand levers 17, 18, 19. The levers 17 and 18 are situated respectively on the sides 2 and 3, of the supply block 1, and the lever 19 is situated on the end face 20 of the supply block, the end face 20 lying at right-angles to the sides 2 and 3. Thus, all the levers 17, 18 and 19 lie in a plane offset at an angle to the operating plane of the main shut-off valves 12, 13 and 14, which contributes to the reduction of operating errors. The branch hose connections 4'' to 7'' are situated on the side of the supply block 1 opposite to the operating plane of the levers 12 to 14.

Figure 7:
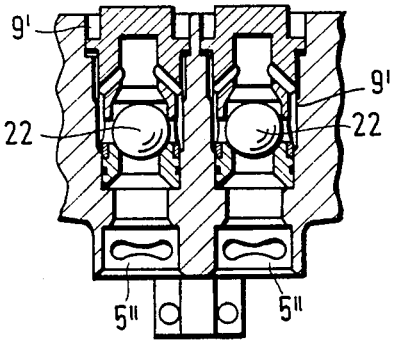
FIG. 7 is a cross-section taken on the line VII—VII of FIG. 2.

The internal passage 8 between the main hose connections 5,5', which is connected to the return conduit, is not provided with a shut-off valve. Similarly, the branch passage 9 which branches off from this internal passage 8 to the branch hose connection 5'' has no shut-off valve. In the preferred embodiment illustrated, the internal passage 8 is connected between the main hose connections 5,5' to two parallel branch passages 9' (see FIG. 7), in each of which there is situated a non-return ball valve 22, which normally closes the relevant branch hose connection from the main return line of the longwall working. The parallel branch passages 9' each end in a respective branch hose connection 5'', one of which forms a connection to a ram or rams charged by the low-pressure medium, while the other forms a connection to working rams which are charged with high-pressure medium.

As shown best in FIG. 5, the closure member 23 of each of the main shut-off valves 11 is situated in a respective bore forming the associated internal passage 8. A connection socket 24 is introduced into this bore, the connection socket serving as a stop for bearing rings and gaskets 25 associated with the closure member 23.

Figure 2:
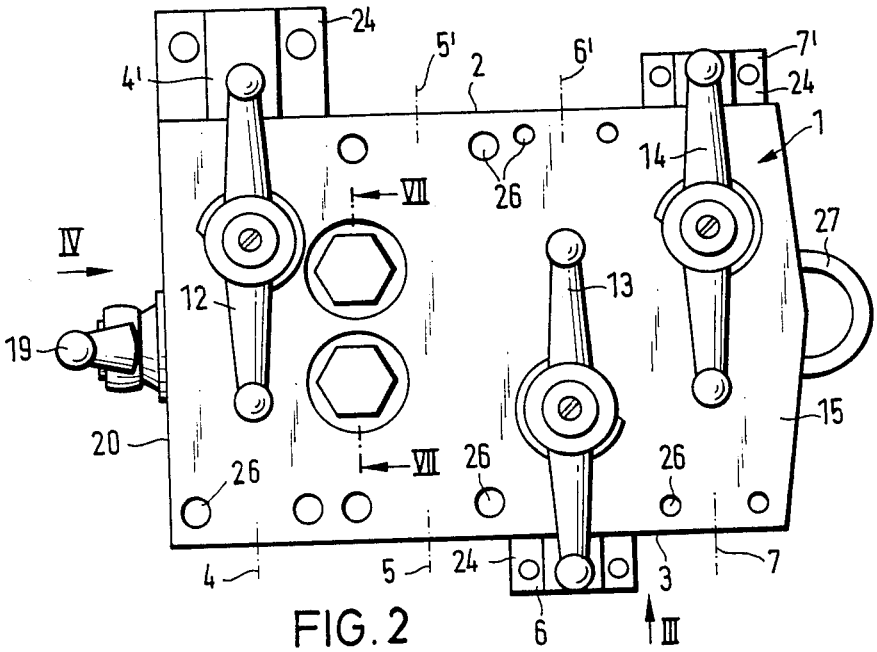
FIG. 2 is a plan view of the distributor.

The connection sockets 24 also define the main hose connections 4', 7' and 6, and protrude outwardly beyond the associated face 2 or 3 respectively (see FIG. 2). On the other hand, the other main hose connections 4, 5, 7 on the side 3, and the connections 5' and 6' on the side 2 of the supply block 1, are formed by simple insert bores in the supply block. Plug-in nipples, which are arranged on the ends of the hoses to be connected, are inserted into the insert bores and made fast, for example by means of U-shaped connectors (not shown). These connectors are inserted, in known manner, into bores 26 of the supply block 1. The connection sockets 24 can be screwed into the associated bores, or can be detachably fixed to the supply block 1 by means of U-shaped connectors such as the connector 27 shown in FIG. 6.

As shown in FIG. 2, the actuating elements (levers) 12, 13 and 14 of the three main shut-off valves 11 are arranged on both sides of the central axis of the supply block 1; with the actuating elements 12 and 14, which are allocated to the main hose connections 4' and 7', lying on one side of the central axis, while the actuating element 13, which is allocated to the main hose connection 6, lies on the opposite side of the central axis. In FIG. 2, the actuating elements (levers) 12, 13 and 14, are each shown in the open position of the associated shut-off valve 11. In this open position, the levers 12, 13 and 14 are aligned with the axes of the associated internal passages 8, and each extends with one lever end over the associated connection socket 24 of the respective main hose connection. Thus, the open and closed positions of the various shut-off valves 11, and their actuating elements (levers) 12, 13 and 14, are easily recognisable.

The branch hose connections 4'', 6'' and 7'' are each also formed by a respective connection socket 28 which engages in the bore of the respective branch passage 9, and is detachably fixed by screwing or by means of a U-shaped connector 27. The connection sockets 28 likewise secure the bearing rings and gaskets 25 allocated to the closure members of the branch shut-off valves 16. As shown in FIG. 5, a filter element 29 and an intermediate ring 30 are arranged in each of the bore sections leading to the connections 6'' and 7'', these members being positioned between the associated connection socket 28 and the associated bearing ring and gasket 25, in order to filter the pressure fluid in that branch.

Figure 3:
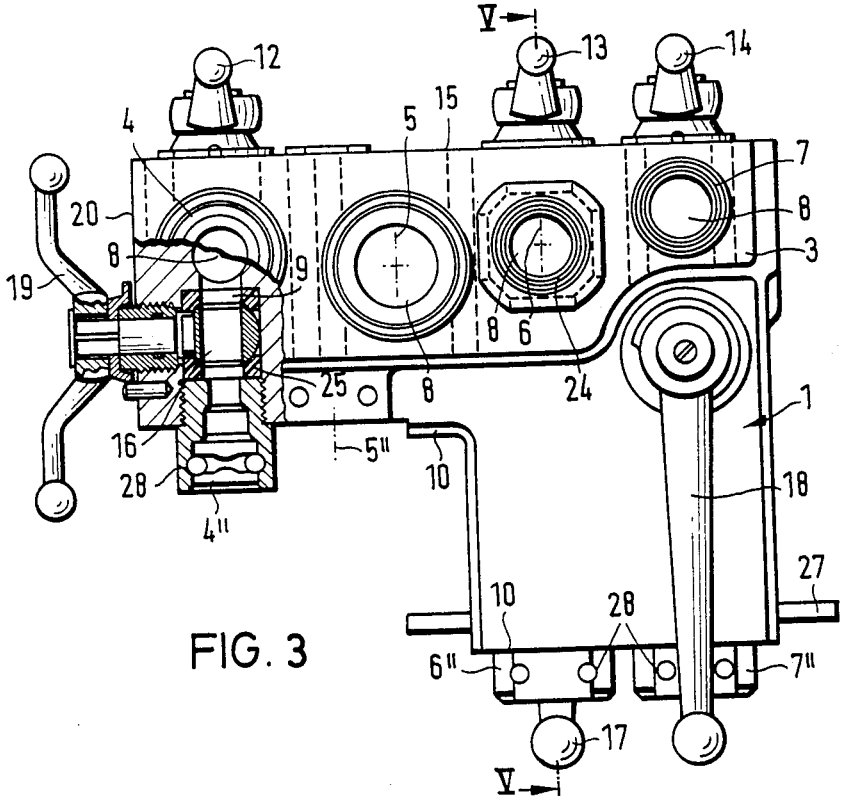
FIG. 3 is a part-sectional view of the distributor looking in the direction of the arrow III in FIG. 2.
Figure 4:
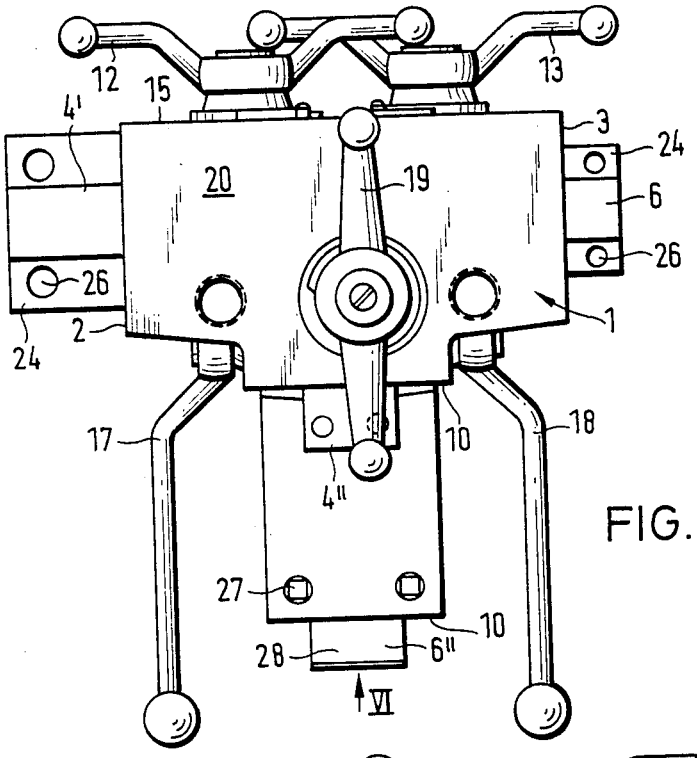
FIG. 4 is a view of the distributor looking in the direction of the arrow IV of FIG. 2.
Figure 6:
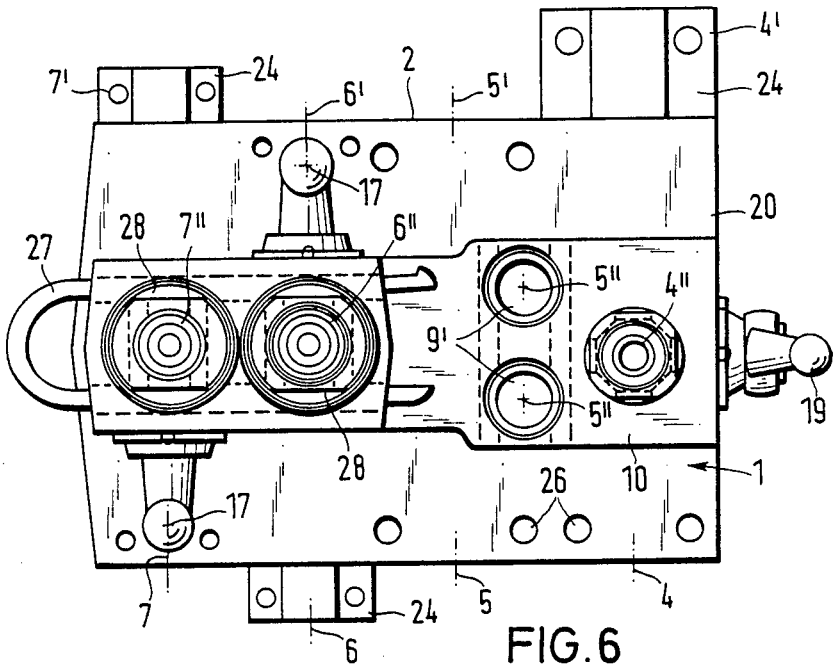
FIG. 6 is a view of the distributor looking in the direction of the arrow VI in FIG. 4.

As shown in FIGS. 3 to 6, the hand levers 17 and 18 are arranged in a concealed position beneath the wider head part of the supply block 1, which carries the main hose connections 4 to 7 and 4' to 7' on its two opposite sides 3 and 2. The hand levers 17 and 18 lie on both sides of the narrower foot part of the supply block 1, at right-angles to the head part, said foot part carrying the branch hose connections 6'' and 7'' on its face 10. When the associated shut-off valves 16 are in the open position, the hand levers 18 cover the connection sockets 28 which form the branch hose connections 6'' and 7'', as shown in FIGS. 3 and 6.

We claim:

1. A distributor for controlling hydraulic distribution between hydraulic consumers of a mine roof support unit and hydraulic service lines extending along a mine working, the distributor comprising: a supply block (1), a plurality of associated pairs of main hose connections (4–7, 4'–7') disposed on opposite external faces of the block, and a plurality of branch hose connections (4''–7'') disposed on another external face (10) of the block, a plurality of main passages (8) formed within the block to individually interconnect the respective hose connections of each associated pair of main hose connections, and a plurality of branch passages (9) formed within the block to individually connect each main passage to a respective branch hose connection, wherein the hose connections of a first pair of main hose connections (6, 6'') are connected into a hydraulic high-pressure line, the hose connections of a second pair of main hose connections (7, 7') are connected into a hydraulic low-pressure line, the hose connections of a third pair of main hose connections (4, 4') are connected into a pressure water line, and the hose connections of a fourth pair of main hose connections (5, 5') are connected into a hydraulic return line, and wherein the main passages connecting the first, second and third pairs of main hose connections each house a main shut-off valve (11), and the branch passages leading to said main passages each house a branch shut-off valve (16).

2. A distributor according to claim 1, wherein each of the main shut-off valves has an actuating element (12, 13, 14), said actuating elements being positioned on a face of the supply block which is arranged at right-angles to said opposite faces.

3. A distributor according to claim 2, each of the branch passages intersects the associated main passage at right-angles, and said other face of the supply block is arranged at right-angles to said opposite faces and opposite to that face on which the actuating elements of the main shut-off valves are positioned.

4. A distributor according to claim 3, wherein the supply block is of generally L-shaped configuration when looking towards one of said opposite faces, the actuating elements of the main shut-off valves being arranged on an upper face of the supply block, and the branch hose connections being arranged on an underneath face of the supply block.

5. A distributor according to claim 4, wherein each of the branch shut-off valves has an actuating element (17, 18, 19), at least some of the actuating elements of the branch shut-off valves being arranged on the L-shaped opposite faces of the supply block.

6. A distributor according to claim 5, wherein a branch shut-off valve actuating element is situated on an end face of the supply block that lies at right-angles to said opposite faces.

7. A distributor according to claim 5, wherein the supply block is generally T-shaped in cross-section with the main hose connections and the actuating elements of the main shut-off valves being arranged on the bar portion of the T-shaped section, and with the branch hose connections and the actuating elements of the branch shut-off valves being arranged on the upright of the T-shaped section.

8. A distributor according to claim 1, wherein the main passage connected into the return line is connected to two parallel branch passages (9'), each of which leads to a branch hose connection.

9. A distributor according to claim 8, wherein a respective non-return valve (22) is arranged in each of said parallel branch passages.

10. A distributor according to claim 5, wherein each of the shut-off valves has a valve closure member, and wherein each passage accommodating a valve closure member has detachably secured therein a respective connection socket, each connection socket serving to secure in position bearing and sealing rings associated with the respective valve closure member.

11. A distributor according to claim 10, wherein the actuating elements of the main shut-off valves are actuating levers, each of which extends, when the associated valve is open, generally parallel to the direction of the associated main passage, and each of which extends, when the associated valve is closed, transversely to said direction.

12. A distributor according to claim 11, wherein the actuating elements of the branch shut-off valves are actuating levers, each of which extends, when the associated valve is open, generally parallel to the direction of the associated branch passage, and each of which extends, when the associated valve is closed, transversely to said direction.

13. A distributor according to claim 12, wherein each of the connection sockets protrudes outwardly of the supply block beyond the associated face of the supply block and is covered by the actuating levers of the associated valve when that valve is open.

* * * * *